US006189164B1

(12) United States Patent
Krapu

(10) Patent No.: US 6,189,164 B1
(45) Date of Patent: Feb. 20, 2001

(54) TOILET SEAT ELEVATING SYSTEM

(76) Inventor: Jon A. Krapu, 2280-24th Ave. NE., Martin, ND (US) 58758

( * ) Notice: Under 35 U.S.C. 154(b), the term of this patent shall be extended for 0 days.

(21) Appl. No.: 09/428,173

(22) Filed: Oct. 27, 1999

(51) Int. Cl.[7] ..... A47K 13/10

(52) U.S. Cl. ..... 4/667; 4/254; 297/313; 297/DIG. 10

(58) Field of Search ..... 4/667, 254, 480; 297/313, DIG. 10

(56) References Cited

U.S. PATENT DOCUMENTS

| | | | | |
|---|---|---|---|---|
| 701,826 | * | 6/1902 | Amerman et al. | 4/480 |
| 801,117 | * | 10/1905 | Stow | 4/480 |
| 3,473,174 | * | 10/1969 | Cool | 4/667 |
| 4,962,551 | * | 10/1990 | Bly | 4/480 |
| 5,142,709 | * | 9/1992 | McGuire | 4/667 |
| 5,155,873 | * | 10/1992 | Bridges | 4/667 |
| 5,189,739 | * | 3/1993 | Thierry | 4/254 |
| 5,309,583 | * | 5/1994 | White et al. | 4/667 |
| 5,556,121 | * | 9/1996 | Pillot | 297/DIG. 10 |
| 5,661,858 | * | 9/1997 | House et al. | 4/667 |
| 5,984,411 | * | 11/1999 | Galumbeck | 297/DIG. 10 |
| 6,035,462 | * | 3/2000 | Bennett et al. | 4/667 |

* cited by examiner

*Primary Examiner*—Charles R. Eloshway

(57) ABSTRACT

A toilet seat elevating system for assisting a physically challenged individual departing a conventional toilet. The toilet seat elevating system includes a frame having a pair of side members, a pair of cross members, and securing members for engaging the lower portion of a conventional toilet. An extendible structure attached to the frame and a seat member for moving the seat member forwardly and upwardly thereby assisting an individual from a seated position. A guide funnel is secured about an opening within the seat member for guiding discharged material directly into the toilet basin. A pair of arm rests are attached to the seat member for assisting the individual during utilization of the device. The extendible structure is comprised of a pair of upper arms and lower arms attached between the frame and the seat member. An actuator is attached between the frame and a lever structure that is pivotally attached to the frame and the seat member thereby elevating the seat member.

10 Claims, 5 Drawing Sheets

TOILET SEAT ELEVATING SYSTEM

BACKGROUND OF THE INVENTION

1. Field of the Invention

The present invention relates generally to toilets and more specifically it relates to a toilet seat elevating system for assisting a physically challenged individual departing a conventional toilet.

Individuals who are physically challenged, such as an elderly person, often times find it difficult to remove themselves from a conventional toilet after utilization. These individuals sometimes injure themselves attempting to remove themselves from the conventional toilets. Sometimes they fall from the toilet attempting to remove themselves. Hence, there is a need for an invention that assists individuals in leaving a toilet after utilization.

2. Description of the Prior Art

Devices to assist individuals from a toilet have been in use for years. Typically, an elongated handle structure is attached to a wall adjacent the toilet for the individual to grasp thereby allowing them to pull themselves up from the toilet.

Unfortunately, some physically challenged individuals do not have the physical strength required to pull themselves from the toilet. Also, some bathrooms do not have a wall adjacent the toilet for these handles to attach to.

Examples of attempts to solve the problem of elevating an individual from a toilet include U.S. Pat. No. 4,185,335 to Alvis; U.S. Pat. No. 3,473,174 to Cool; U.S. Pat. No. 5,592,703 to Jones et al.; U.S. Pat. No. 5,561,872 to Phillips; U.S. Pat. No. 5,142,709 to McGuire; U.S. Pat. No. 4,993,085 to Gibbons; U.S. Pat. No. 4,833,736 to Sadler et al.; U.S. Pat. No. 4,168,552 to Austin; U.S. Pat. No. 5,027,446 to Robertson; U.S. Pat. No. 5,603,130 to Snijders et al.; U.S. Pat. No. 4,777,671 to Kearns; U.S. Pat. No. 4,587,678 to Love et al. which; U.S. Pat. No. 4,031,576 to Epstein; U.S. Pat. No. 3,925,833 to Hunterare all illustrative of such prior art.

Alvis (U.S. Pat. No. 4,185,335) discloses a movable toilet seat assembly. Alvis teaches a platform that is elevated by a pair of hydraulic cylinders. Alvis is positionable about an existing toilet.

Cool (U.S. Pat. No. 3,473,174) discloses a seat construction for assisting an individual from a conventional toilet. Cool teaches an upstanding frame member with side sections, an interconnection means and associated power operable means between the frame member and the seat for selectively pivoting the seat upwardly and forwardly.

Jones et al. (U.S. Pat. No. 5,592,703) discloses a powered toilet seat lift for assisting a physically challenged person to use a toilet. Jones et al. teaches a toilet seat having a passageway therethrough, a baseplate positioned about the base of a toilet bowl, and a pair of hydraulic cylinders supporting the toilet seat for vertical movement between a lowered and elevated position.

Phillips (U.S. Pat. No. 5,561,872) discloses an apparatus for raising and lowering a toilet seat. Phillips teaches a frame having a U-shaped base and a pair of parallel spaced support members projecting upwardly from the base at an inclined angle for supporting a pair of telescopic arms.

McGuire (U.S. Pat. No. 5,142,709) discloses a hydraulic commode assembly for lowering a handicapped person from a standing position to a seated position. McGuire teaches a hydraulc cylinder that operates on household water pressure for ellevating a seat.

While these devices may be suitable for the particular purpose to which they address, they are not as suitable for assisting a physically challenged individual departing a conventional toilet. Conventional methods of assisting individuals from a toilet seat require a wall or similar structure adjacent the toilet along with the ability of the individual to pull themselves from the toilet. Attempted modifications are not suitable in the respect that they do not provide a simple and affordable structure that can be purchased by the average consumer.

In these respects, the toilet seat elevating system according to the present invention substantially departs from the conventional concepts and designs of the prior art, and in so doing provides an apparatus primarily developed for the purpose of assisting a physically challenged individual departing a conventional toilet.

SUMMARY OF THE INVENTION

In view of the foregoing disadvantages inherent in the known types of physical aid devices now present in the prior art, the present invention provides a new toilet seat elevating system construction wherein the same can be utilized for assisting a physically challenged individual departing a conventional toilet.

The general purpose of the present invention, which will be described subsequently in greater detail, is to provide a new toilet seat elevating system that has many of the advantages of the physical aid devices mentioned heretofore and many novel features that result in a new toilet seat elevating system which is not anticipated, rendered obvious, suggested, or even implied by any of the prior art toilet aid devices, either alone or in any combination thereof.

To attain this, the present invention generally comprises a frame having a pair of side members, a pair of cross members, and securing members for engaging the lower portion of a conventional toilet. An extendible structure attached to the frame and a seat member for moving the seat member forwardly and upwardly thereby assisting an individual from a seated position. A guide funnel is secured about an opening within the seat member for guiding discharged material directly into the toilet basin. A pair of arm rests are attached to the seat member for assisting the individual during utilization of the device. The extendible structure is comprised of a pair of upper arms and lower arms attached between the frame and the seat member. An actuator is attached between the frame and a lever structure that is pivotally attached to the frame and the seat member thereby elevating the seat member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet seat elevating system that will overcome the shortcomings of the prior art devices.

Another object is to provide a toilet seat elevating system that assists a physically challenged individual departing a conventional toilet.

An additional object is to provide a toilet seat elevating system that elevates a physically challenged individual from a seated position into an upright position from which they may comfortably stand.

A further object is to provide a toilet seat elevating system that reduces the physical strain placed upon an individual's body when departing a conventional toilet.

Another object is to provide a toilet seat elevating system that assists in lowering an individual from an elevated position to a seated position about a conventional toilet.

A further object is to provide a toilet seat elevating system that is positionable about an existing conventional toilet.

Another object is to provide a toilet seat elevating system that is adjustable for various heights of toilets.

An additional object is to provide a toilet seat elevating system that can be easily installed about a conventional toilet.

Another object is to provide a toilet seat elevating system that does not require significant modification of an existing conventional toilet.

A further object is to provide a toilet seat elevating system that provides a physically challenged individual an independent lifestyle along with the preservation of dignity in private situations.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
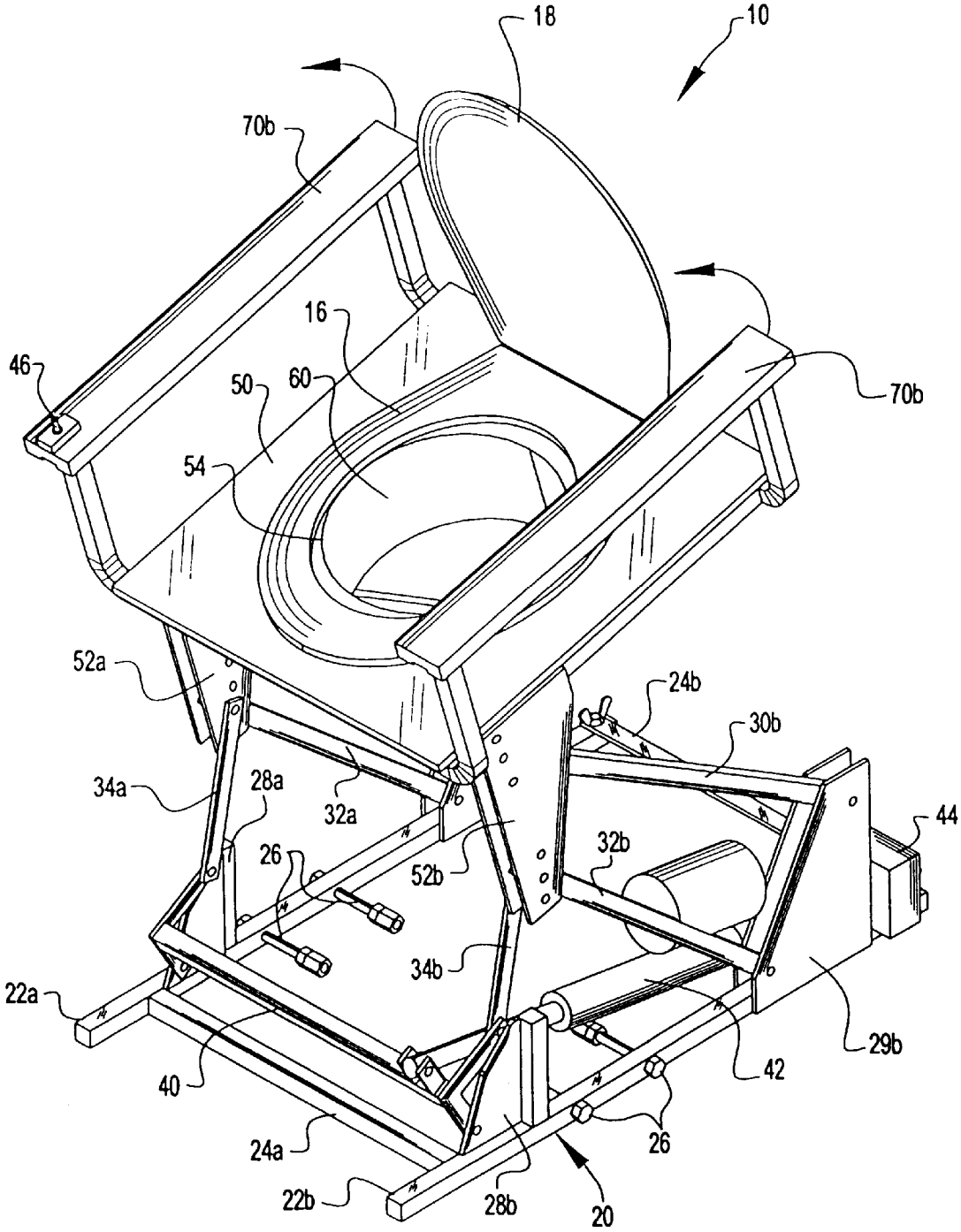
FIG. 1 is an upper perspective view of the present invention in an elevated position.

Turning now descriptively to the drawings, in which similar reference characters denote similar elements throughout the several views, FIGS. 1 through 5 illustrate a toilet seat elevating system 10, which comprises a frame 20 having a pair of side members 22*a–b,* a pair of cross members 24*a–b,* and securing members 26 for engaging the lower portion of a conventional toilet 12. An extendible structure attached to the frame 20 and a seat member 50 for moving the seat member 50 forwardly and upwardly thereby assisting an individual from a seated position. A guide funnel 60 is secured about an opening 54 within the seat member 50 for guiding discharged material directly into the toilet basin 14. A pair of arm rests 70*a–b* are attached to the seat member 50 for assisting the individual during utilization of the device. The extendible structure is comprised of a pair of upper arms 30*a–b* and lower arms 32*a–b* attached between the frame 20 and the seat member 50. An actuator 42 is attached between the frame 20 and a lever structure 40 that is pivotally attached to the frame 20 and the seat member 50 thereby elevating the seat member 50.

Figure 2:
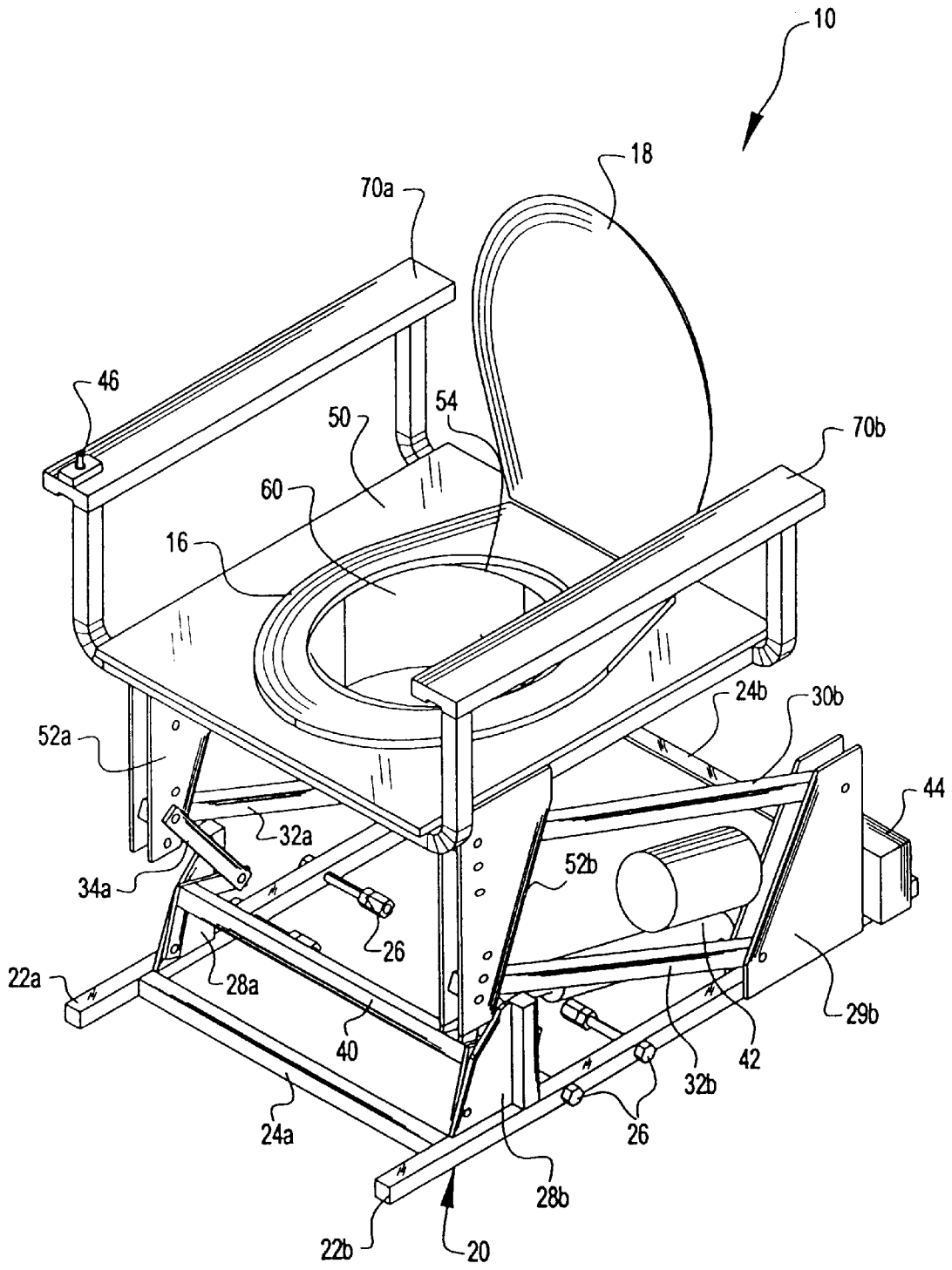
FIG. 2 is an upper perspective view of the present invention in a lowered position.

As best shown in FIGS. 1 and 2 of the drawings, the frame 20 is comprised of a pair of side members 22*a–b* that extend parallel to one another. A pair of cross members 24*a–b* are attached between the pair of side members 22*a–b* as best shown in FIGS. 1 and 2 of the drawings. As shown in FIGS. 1 through 4 of the drawings, the rear cross member 24*b* is removably attachable between the side members 22*a–b* for allowing the conventional toilet 12 to be positioned within the frame 20. The frame 20 may be comprised of any well-known material.

As best shown in FIGS. 1 and 2 of the drawings, a plurality of securing members 26 are threadably attached to the frame 20. The securing members 26 are tightened about the lower portion of the conventional toilet 12 after the frame 20 is positioned about the conventional toilet 12 thereby preventing the frame 20 from moving with respect to the conventional toilet 12. Various other well-known means may be utilized for securing the frame 20 to the conventional toilet 12.

Figure 3:
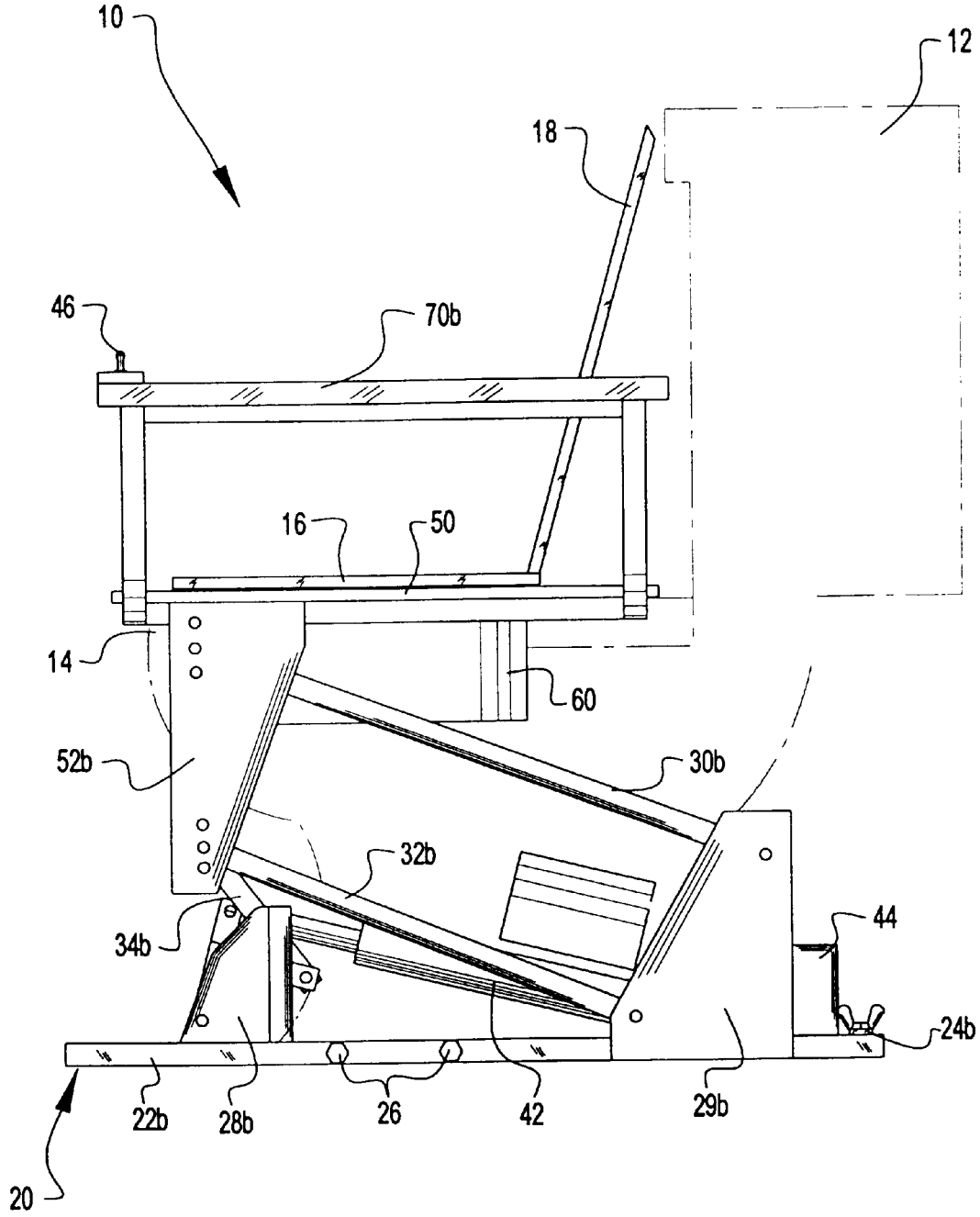
FIG. 3 is a side view of the present invention in a lowered position about a conventional toilet.
Figure 4:
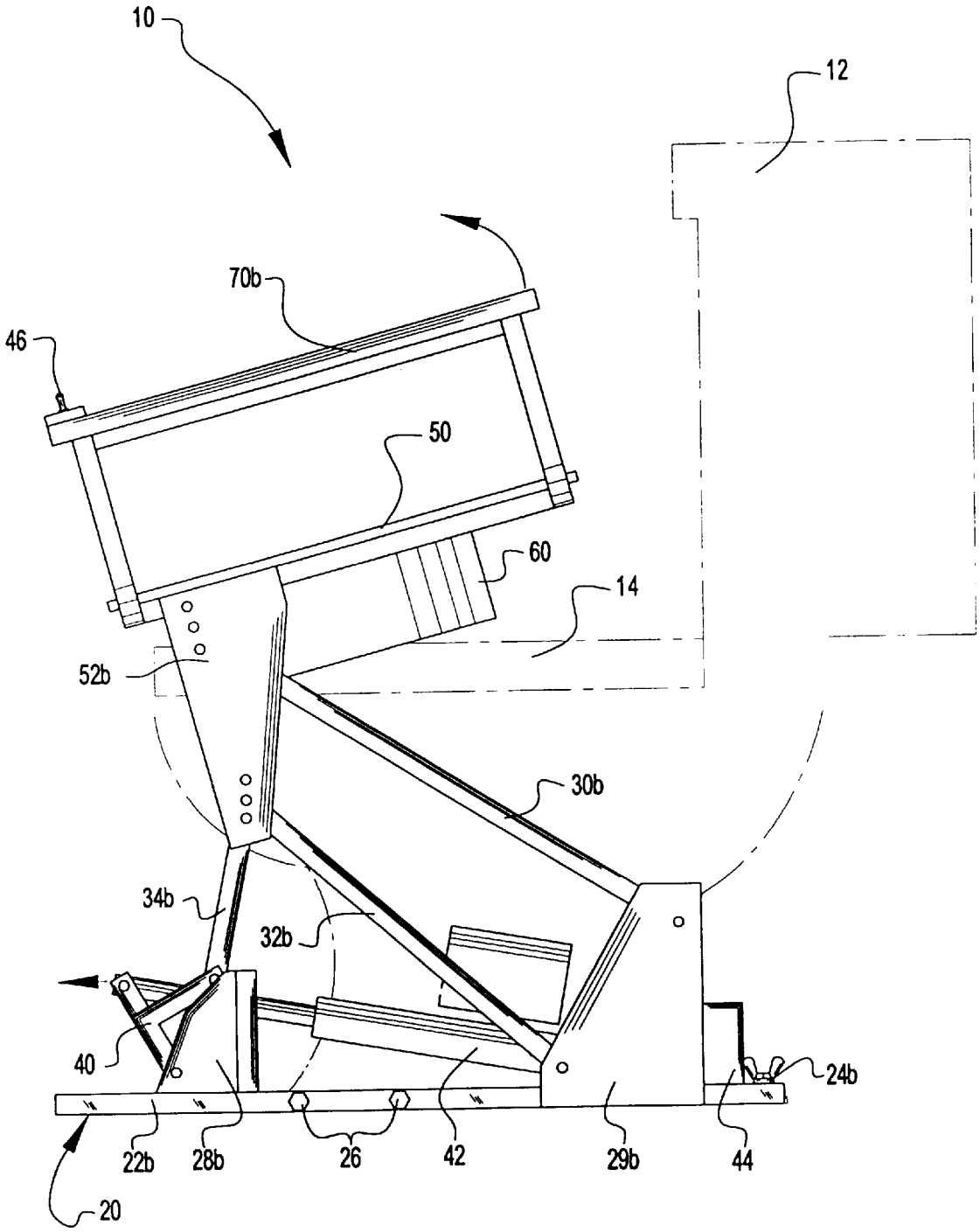
FIG. 4 is a side view of the present invention in an elevated position about a conventional toilet.

As shown in FIGS. 1 through 5 of the drawings, a pair of rear brackets 29*a–b* are attached to the rear portion of the frame 20. The rear brackets 29*a–b* pivotally receive a pair of upper arms 30*a–b* and a pair of lower arms 32*a–b*. The upper arms 30*a–b* are positioned above the lower arms 32*a–b*. As best shown in FIGS. 3 and 4 of the drawings, the lower arms 32*a–b* are preferably shorter than the upper arms 30*a–b* for tilting the seat member 50 forwardly as the seat member 50 is elevated.

As shown in FIGS. 1 through 4 of the drawings, a seat member 50 is provided preferably having a flat structure thereto. A central opening 54 extends through the seat member 50 that corresponds with the toilet basin 14 of the conventional toilet 12. As shown in FIGS. 1 through 4 of the drawings, a toilet seat 16 is attached to the seat member 50 about the opening 54 for providing a comfortable support for the user during use. A toilet lid 18 may also be attached to the seat member 50 for allowing selective closing of the opening 54. A pair of arm rests 70*a–b* are preferably attached to the upper surface of the seat member 50 for the user to grasp during utilization of the present invention.

As shown in FIGS. 1 through 5 of the drawings, a guide funnel 60 is attached to the underside of the seat member 50 about the opening 54 for guiding discharged material directly into the toilet basin 14 without having an undesirable mess about the toilet 12.

As shown in FIGS. 1 through 5 of the drawings, a pair of side brackets 52*a–b* are attached to the seat member 50 and preferably extend downwardly. The distal ends of the upper arms 30*a–b* and the lower arms 32*a–b* pivotally engage the pair of side brackets 52*a–b* for elevating and tilting the seat member 50 with respect to the conventional toilet 12. It can be appreciated that there are a plurality of apertures upon the side brackets 52*a–b* that arms 30*a–b,* 32*a–b* can be pivotally attached to thereby allowing adjustment of the lowered height of the seat member 50 depending upon the height of the conventional toilet 12.

Figure 5:
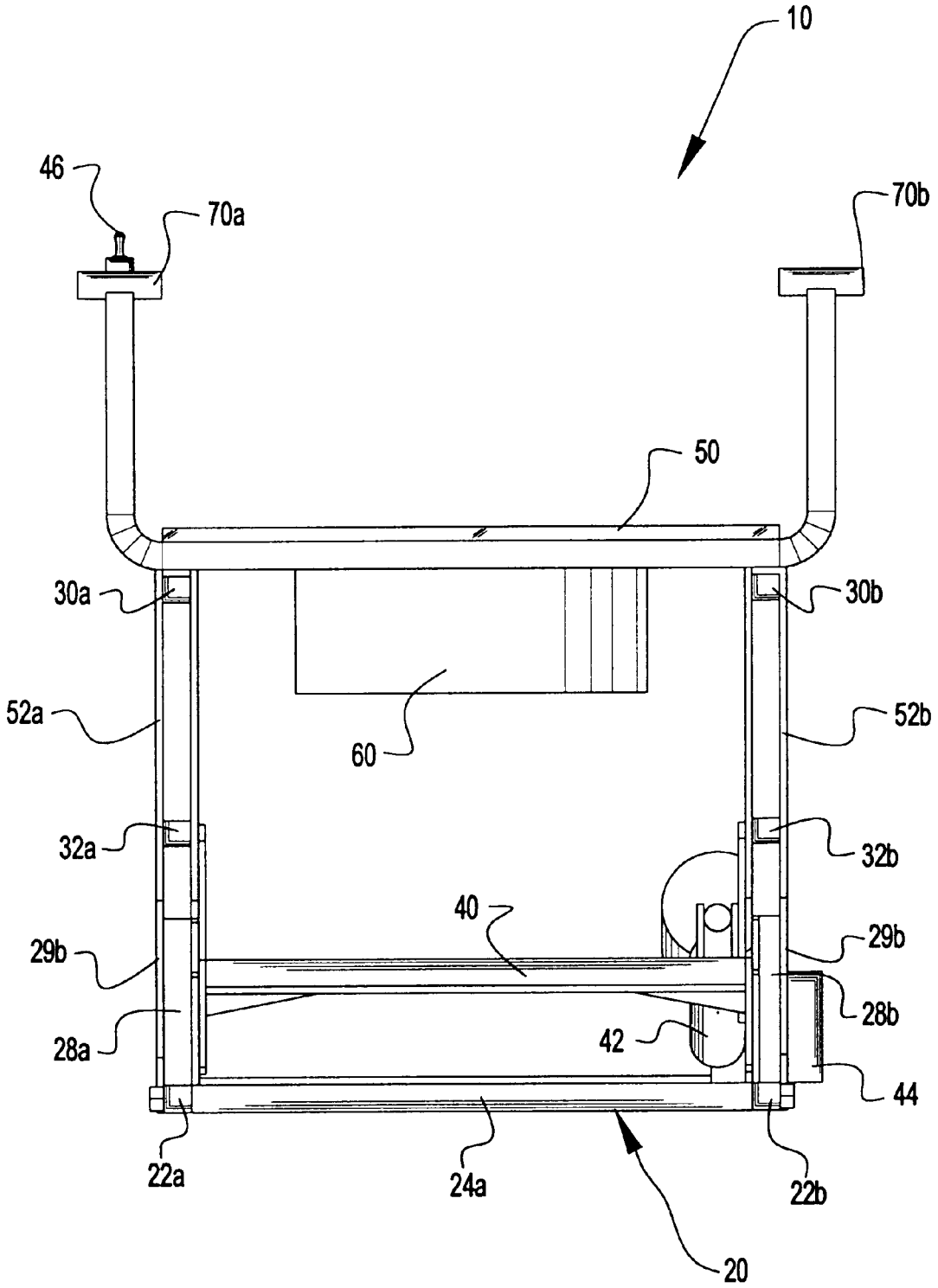
FIG. 5 is a front view of the present invention.

As shown in FIGS. 1 and 2 of the drawings, a pair of front brackets 28*a–b* are attached to the frame 20 opposite of the rear brackets 29*a–b*. The lever structure 40 is pivotally attached between the pair of front brackets 28*a–b* as best shown in FIG. 5 of the drawings. The lever structure 40 has an L-shaped cross section that is pivotally attached to a pair of leverage arms 34*a–b* as shown in FIGS. 1 and 4 of the drawings. The distal ends of the leverage arms 34*a–b* are pivotally attached to the side brackets 52*a–b* of the seat member 50 for elevating the seat member 50.

As shown in FIGS. 1 through 4 of the drawings, an actuator 42 is attached to the frame 20 and mechanically engages a portion of the lever structure 40 for allowing selective rotation of the lever structure 40 with respect to the frame 20. The actuator 42 may be comprised of any well-known device such as hydraulic cylinders or electric motors. It can be appreciated that more than one actuator 42 may be utilized upon the present invention depending upon the loads applied to the seat member 50.

As shown in FIGS. 1 through 4 of the drawings, a control unit 44 is attached to the frame 20 or other structure of the present invention. The control unit 44 is electrically connected to the actuator 42 for controlling the mechanical movements of the actuator 42. The control unit 44 is programmable for allowing programming of such variables as the speed of the actuator 42, delay features, and automatic return of the seat member 50 to a resting position.

A control switch 46 is preferably attached to one of the arm rests 70*a–b* as shown in FIGS. 1 through 4 of the drawings. The control switch 46 is electrically connected to the control unit 44 for allowing the individual to control the movements of the seat member 50 while sitting upon the seat member 50.

In use, the user removes the seat and lid from the conventional toilet 12. The user then removes the rear cross member 24*b* and positions the frame 20 about the conventional toilet 12 so that the guide funnel 60 is aligned directly above the toilet basin 14 of the conventional toilet 12. The user then manipulates the securing members 26 so that the frame 20 of the present invention is attached to the conventional toilet 12 thereby preventing movement during operation and use. The user then determines if the arms 30*a–b,* 32*a–b* are attached in the desired locations upon the side brackets 52*a–b* dependent upon the height of the toilet basin 14. The user then programs the control unit 44 for the appropriate speed of the actuator 42 and the amount of time the user wants the seat member 50 to remain in an upright position. For example, the user may desire to have the seat member 50 stay in an upright position for 10 seconds prior to returning to the lowered position. In addition, the user may not want the seat member 50 to automatically return to the lowered position since they may want to utilize the seat member 50 to lower them upon the conventional toilet 12. The user then sits upon the seat member 50 and utilizes the conventional toilet 12. When finished the user manipulates the control switch 46 so that the actuator 42 extends thereby pivoting the lever structure 40 which elevates the seat member 50 as shown in FIGS. 1 and 4 of the drawings. As the seat member 50 is elevated, it is tilted forwardly because the lower arms 32*a–b* are shorter in length than the upper arms 30*a–b* as shown in FIG. 4 of the drawings. The actuator 42 continues elevating the seat member 50 until in the upright position as shown in FIG. 4. The seat member 50 remains in the upright position until the desired delay time is expended thereafter the actuator 42 lowers the seat member 50 back into the lower position about the conventional toilet 12 as shown in FIGS. 2 and 3 of the drawings. It can be appreciated that the user may utilize the present invention to lower themselves upon the conventional toilet 12 and that they may manipulate the control switch 46 to manually return the seat member 50 to the lower position. It can be appreciated that the present invention may be utilized by itself as a commode for those confined to a bedroom. If utilized as a commode, the present invention would include an attachable backrest that secures to the rear portion of the present invention for supporting an individual's back.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat elevating system, comprising:

a frame positionable about a toilet;

an elevating means attached to said frame wherein said elevating means comprises:

a control unit;

a control switch electrically connected to said control unit;

at least one actuator attached to said frame and electrically connected to said control unit;

a lever structure pivotally attached to said frame and mechanically connected to a seat member having an opening therein by a pair of leverage arms, wherein said at least one actuator is connected to said lever structure;

a pair of upper arms pivotally attached between said seat member and said frame; and a pair of lower arms pivotally attached between said seat member and said frame;

said seat member attached to said elevating means, wherein said elevating means elevates said seat member from a lowered position to a raised position;

a securing means attached to said frame for securing said frame about said toilet, wherein said securing means comprises a plurality of securing members threadably attached to said frame for engaging a lower portion of said toilet.

2. The toilet seat elevating system of claim 1, including a pair of arm rests attached to said seat member.

3. The toilet seat elevating system of claim 2, including a toilet seat and a toilet lid attached to said seat member.

4. The toilet seat elevating system of claim 1, wherein said lower arms are shorter in length than said upper arms.

5. The toilet seat elevating system of claim 4, wherein said lower arms and said upper arms are adjustably attached to a plurality of apertures within a pair of side brackets for allowing adjustment of the height of said seat member in said lowered position.

6. The toilet seat elevating system of claim 1, including a guide funnel attached to said seat member about said opening for guiding material into a toilet basin of said toilet.

7. The toilet seat elevating system of claim 1, wherein said control unit is programmable.

8. A toilet seat elevating system, comprising:

a frame positionable about a toilet;

an elevating means attached to said frame, wherein said elevating means tilts a seat member having an opening therein forwardly simultaneously while elevating said seat member;

said seat member attached to said elevating means, wherein said elevating means elevates said seat member from a lowered position to a raised position;

wherein said frame is comprised of:

a pair of side members extending parallel to one another;

a first cross member secured to a front portion of said pair of side members; and a second cross member removably attachable to a rear portion of said pair of side members;

a plurality of securing members threadably and traversely positioned within said pair of side members of said frame for securing said frame to a lower base portion of said toilet.

9. The toilet seat elevating system of claim 8, including a pair of arm rests attached to said seat member.

10. The toilet seat elevating system of claim 9, including a toilet seat and a toilet lid attached to said seat member.

* * * * *